US005746400A

United States Patent [19]

Remington et al.

[11] Patent Number: 5,746,400

[45] Date of Patent: May 5, 1998

[54] RAIL CROSSING ASSEMBLY

[75] Inventors: James A. Remington, St. Joseph, Mo.; Kenneth L. Schultz, Orland Park, Ill.; Russell R. Hein, Collierville, Tenn.

[73] Assignee: ABC Rail Products Corporation, Chicago, Ill.

[21] Appl. No.: 759,958

[22] Filed: Dec. 3, 1996

[51] Int. Cl.[6] ..... E01B 7/00

[52] U.S. Cl. ..... 246/465; 246/472; 246/454

[58] Field of Search ..... 246/454, 458, 246/463, 465, 467, 472

[56] References Cited

U.S. PATENT DOCUMENTS

| | | | |
|---|---|---|---|
| 285,511 | 9/1883 | Pierce | 246/463 |
| 325,778 | 9/1885 | Wright | 246/463 |
| 356,364 | 1/1887 | Johnson | 246/463 |
| 570,082 | 10/1896 | Braine | 246/463 |
| 792,365 | 6/1905 | Strom | 246/463 |
| 979,479 | 12/1910 | Elfborg | 246/465 |
| 1,406,909 | 2/1922 | Strom et al. | 246/463 |
| 1,548,162 | 8/1925 | Nichols | 246/465 |
| 1,632,725 | 6/1927 | Brown | 246/465 |
| 1,748,600 | 2/1930 | Einstein | 246/463 |
| 1,803,420 | 5/1931 | Balkwill | 246/463 |
| 2,003,398 | 6/1935 | Strong et al. | 246/465 |
| 2,500,710 | 3/1950 | Schulze | 246/465 |
| 3,096,057 | 7/1963 | Devaney | 246/465 |
| 5,531,409 | 7/1996 | Willow | 246/463 |

*Primary Examiner*—Mark T. Le
*Attorney, Agent, or Firm*—Thomas S. Baker, Jr.

[57] ABSTRACT

A railroad trackwork rail crossing having four rail intersection corners is comprised, at each corner, of four corner casting elements which have angled planforms, co-operating straight intermediate rail elements, co-operating straight guard rail elements, cooperating straight traffic rail elements, and bolt fasteners joining the casting and rail elements into a rigid unitary rail crossing structure.

6 Claims, 8 Drawing Sheets

RAIL CROSSING ASSEMBLY

FIELD OF THE INVENTION

This invention relates generally to railroad trackworks, and particularly concerns a novel rail crossing assembly which obtains substantial manufacturing and operating maintenance economic advantages in comparison to known rail crossing constructions.

BACKGROUND OF THE INVENTION

Most rail crossings incorporated in railroad trackworks constructed in the United States are classified into one of three different design types. The three-rail rail crossing design of American Railway Engineering Association (AREA) Plan No. 701, for example, was once extensively utilized. However, utilization in recent years has diminished in view of the availability of newer and improved rail crossing designs and in view of the heavier rail loadings, heavier trackwork traffic density, and higher railcar operating speeds that are typically now being encountered in the industry. Three-rail design (and even its two-rail variation) rail crossings normally are not weld-repairable in the field, such as to correct for excessive rail wear, because of the need for closely controlled preheating and postheating of the rail steel. Also, a requirement for the replacement of failed crossing components with custom machined parts makes field repair of this type of rail crossing assembly both quite difficult and costly.

The solid manganese rail crossing design of AREA Plan No. 771 is frequently incorporated into trackwork constructions and does have the advantage of being field-weldable to restore worn or damaged crossing surface areas. However, this particular type of rail crossing is characterized by high initial manufacturing cost. This type of rail crossing's end frog castings may be interchanged, but such is seldom undertaken because each typically experiences an equal amount of wear. The same consideration also applies to the design's included center frog castings.

The third type and the most-widely used rail crossing construction in the United States at the present time is believed to be the reversible manganese insert rail crossing of AREA Plan No. 747. The unique configuration of the one-piece insert casting included at each corner of the rail crossing in this construction requires that all of the additionally included external rail components have one bend and that all of the also included internal rail components have two bends. Such bends are difficult to control in manufacture as to fit and retained hardness and thus are costly to make and normally are not repaired in the field.

We have discovered a novel rail crossing construction that overcomes the shortcomings associated with the known rail crossing assemblies incorporated in railroad trackworks utilized in the United States. Other advantages of the present invention arise out of the elimination of included rail bends, the minimization of corner casting size to effect a reduction in foundry material and labor costs, the ability to repair the crossing in the field and the simplification of assembly component machining requirements. Still other objects and advantages of the present invention will become apparent from a careful consideration of the descriptions and drawings which follow.

SUMMARY OF THE INVENTION

The rail crossing assembly of the present invention has four corners (sometimes separately identified by different letters or numbers), and each corner is basically comprised of four corner castings which are joined but in spaced-apart relation to form intersecting rail car wheel flangeways. In the case of a right-angled rail crossing assembly configuration, the four corner castings are made identical in planform; in the case of an oblique-angled rail crossing assembly configuration, the four corner castings are comprised of two acute-angled planform corner castings co-operating with two supplementary obtuse-angled planform corner castings.

The joined outboard ends of each co-operating pair of corner castings in the assembly are joined to a respective straight traffic rail element and to a respective straight guard rail element. The joined inboard ends of each co-operating pair of corner castings are joined to a pair of spaced-apart, straight intermediate rail elements. Joining of the rail crossing assembly corner castings, straight intermediate rail elements, outboard traffic rail elements, and outboard guard rail elements into a unitary, rigid structure is preferably accomplished using properly sized and positioned filler elements and threaded nut and bolt fasteners to establish the rail car wheel flangeways required by the assembly.

It is important to note that the corner casting elements of the rail crossing invention need not necessarily be cast using a manganese steel material; other types of steels such as the highstrength, low-alloy steels, bainitic steels, and eutectoid steels utilized in the industry are more likely to be better suited for most rail crossing construction applications that are now anticipated.

DETAILED DESCRIPTION

Figure 1:
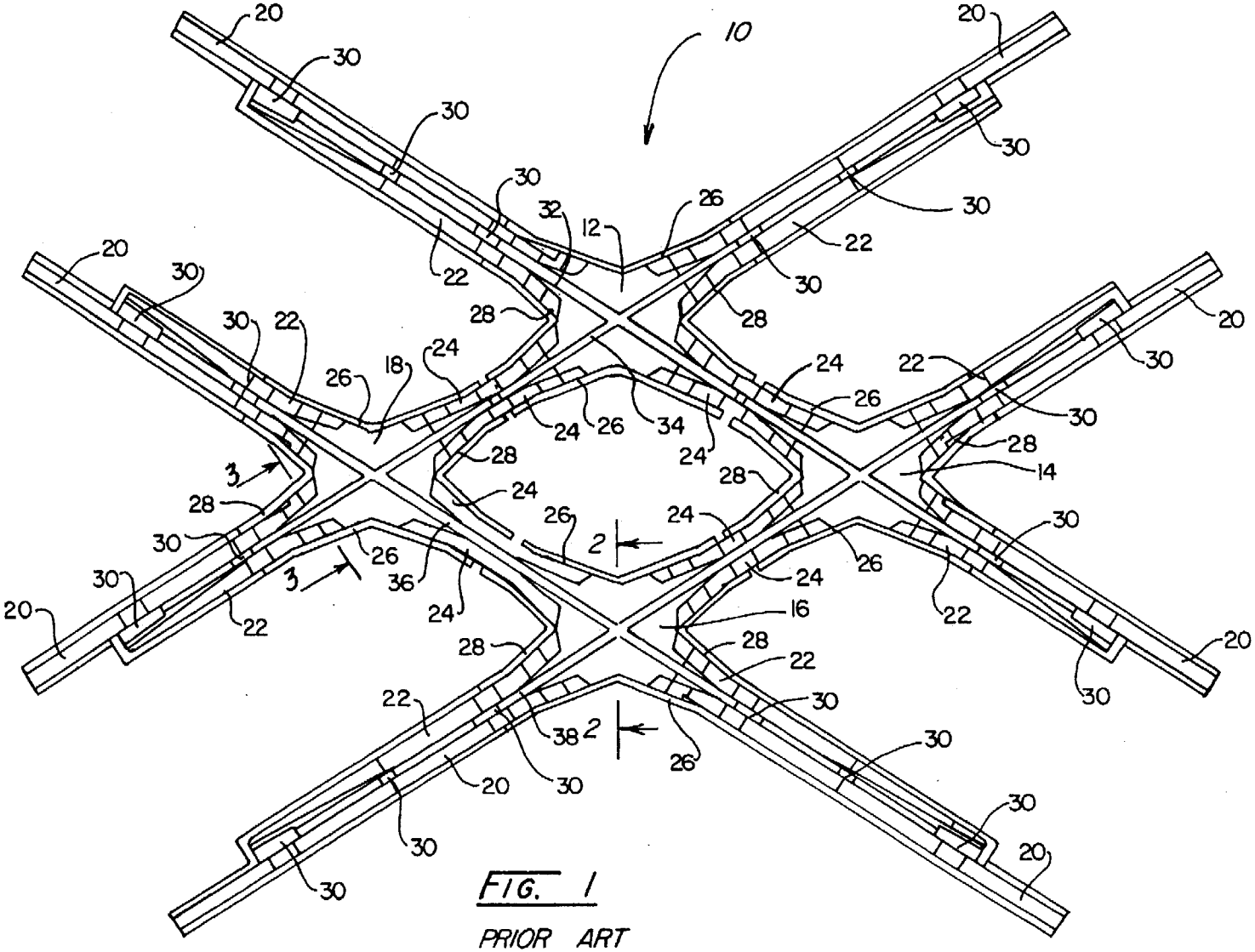
FIG. 1 PRIOR ART
FIG. 1 is a plan view of a widely utilized reversible manganese steel insert type of railroad trackworks rail crossing.
Figure 2:
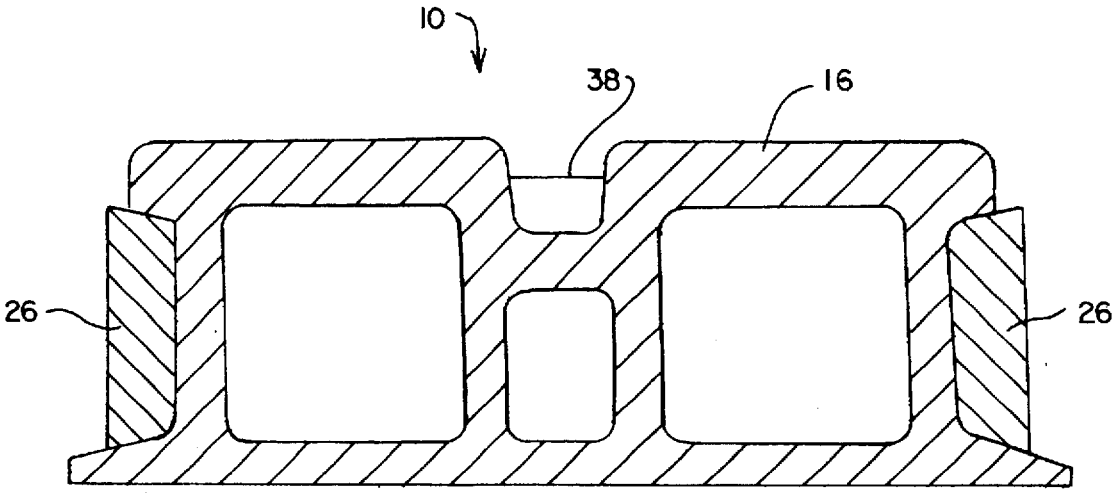
FIG. 2 PRIOR ART
FIG. 2 is a section view taken at line 2—2 of FIG. 1.
Figure 3:
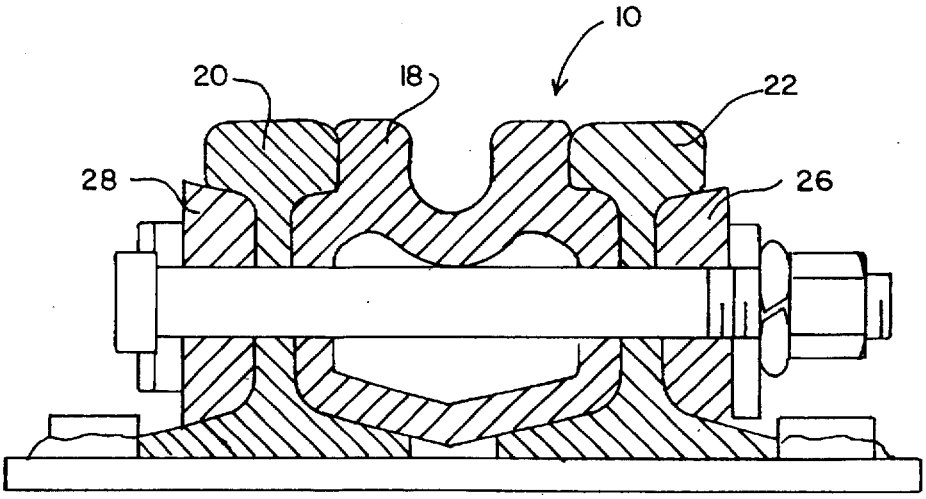
FIG. 3 PRIOR ART
FIG. 3 is a section view taken at line 3—3 of FIG. 1.

FIGS. 1 through 3 of the drawings illustrate details of a representative reversible manganese steel insert type of rail crossing assembly now being widely utilized in railroad trackwork systems throughout the United States. Such rail crossing assembly is commonly identified as an AREA Plan No. 747 manganese steel insert crossing, is referenced generally by the numeral 10 in the drawings, and is comprised of four reversible manganese insert corner castings 12 through 18, of eight outboard bent traffic rail elements 20, of eight outboard bent guard rail elements 22, of eight bent intermediate rail elements 24, of eight obtuse corner strap elements 26, of eight acute corner strap elements 28, and of numerous filler elements 30 that all are joined into a unitary, rigid assembly having continuous, straight-line wheel tread support surfaces and continuous, straight-line and intersecting wheel flangeways 32, 34, 36, and 38. The various included bolt and nut fasteners join components 12 through 30 together. The adjunct support ties, base plates, and rail fasteners, which complete a typical rail crossing installation are not shown in the drawings. Section views taken at lines 2—2 and 3—3 of FIG. 1 are provided in FIGS. 2 and 3, respectively.

Figure 4:
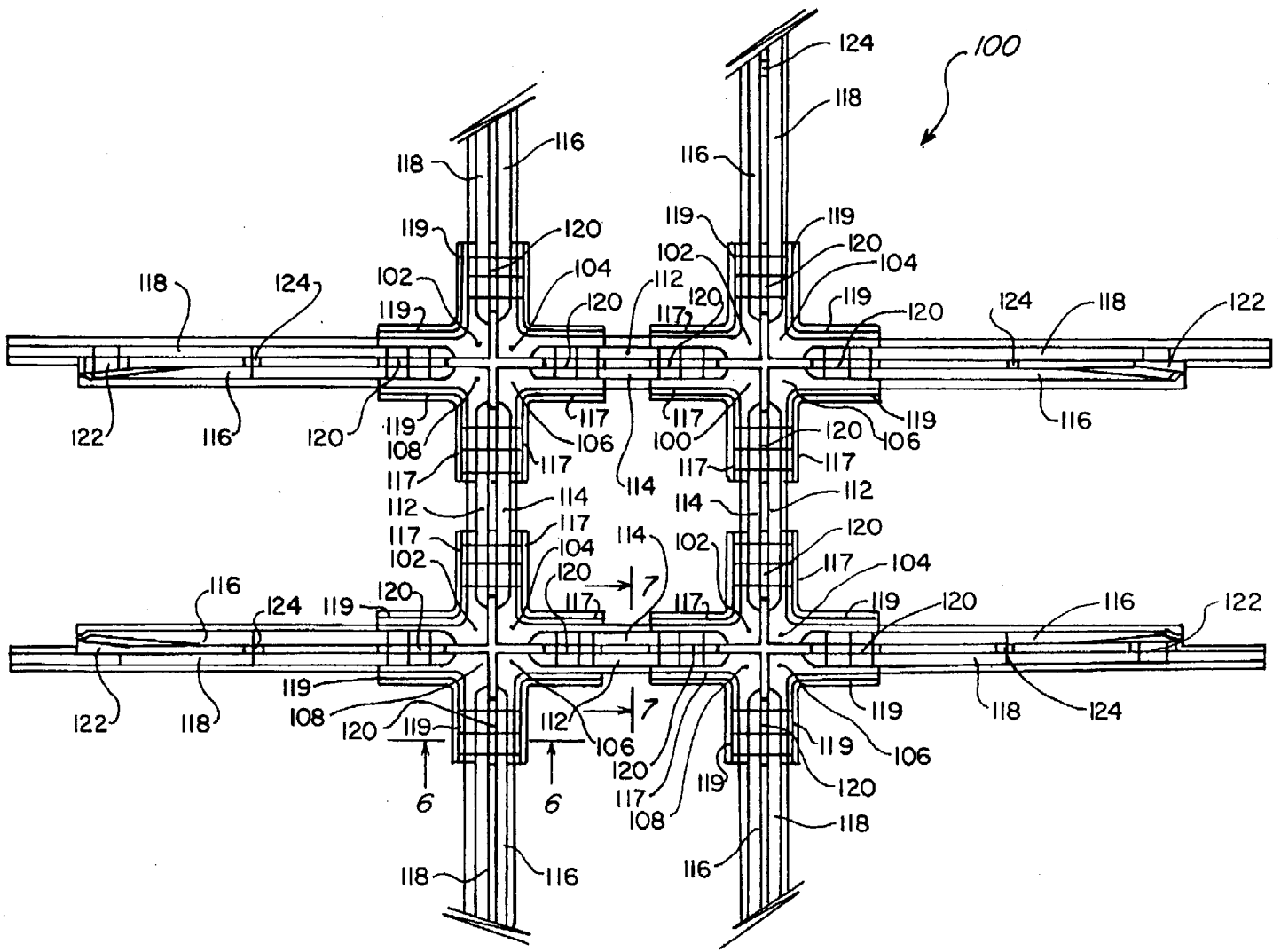
FIG. 4 is a plan view of a preferred embodiment of the rail crossing assembly of the present invention for a right-angled intersection or in a rectangular planform configuration.
Figure 5:
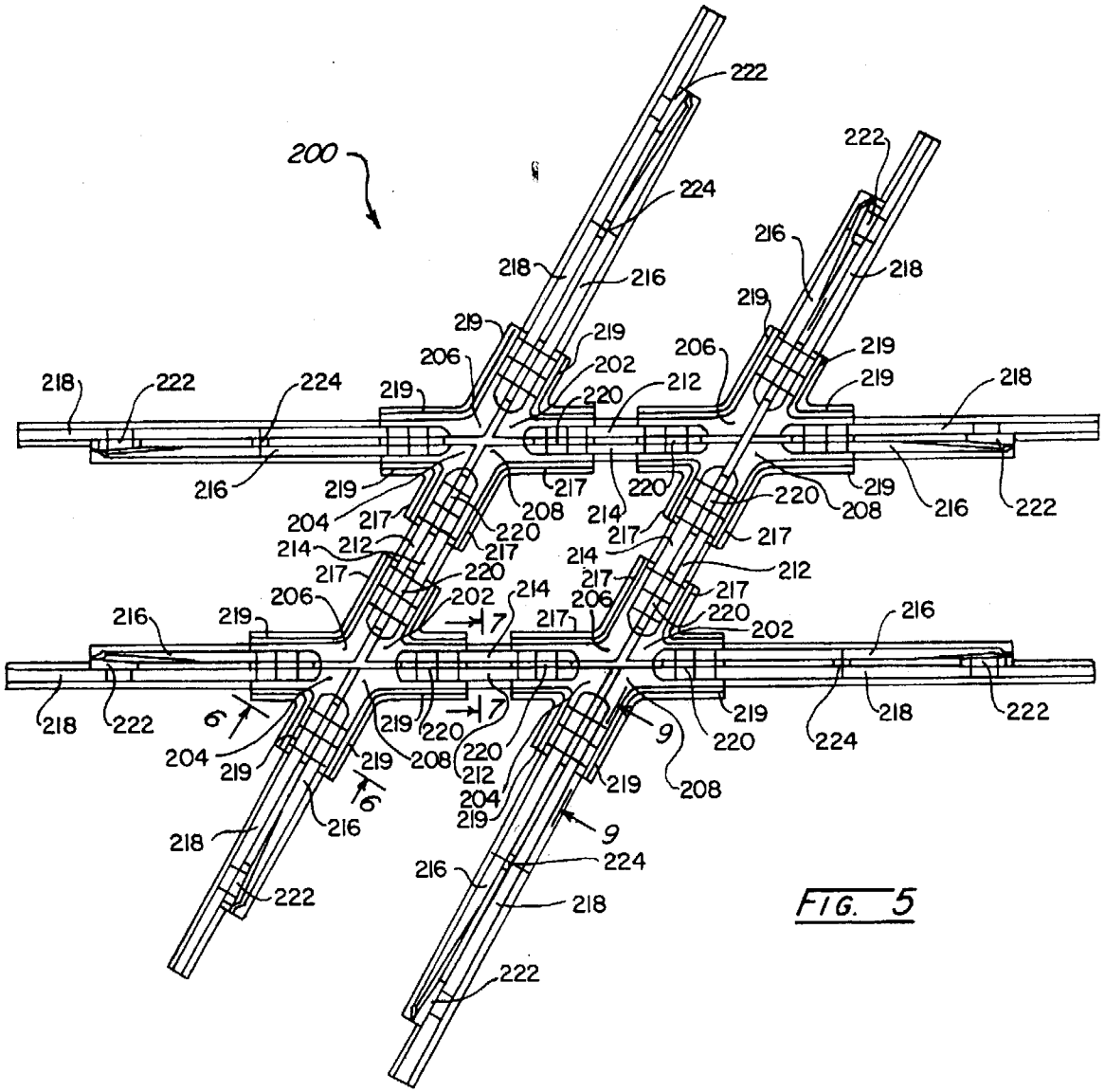
FIG. 5 is a plan view of a preferred embodiment of the rail crossing assembly of the present invention for an oblique-angled track intersection of in a trapezoidal (diamond) planform configuration.

A preferred embodiment of the present rail crossing assembly invention is illustrated in two different planform configurations in FIGS. 4 and 5 of the drawings. Assembly 100 of FIG. 4 is a rail crossing assembly for a right-angled track intersection; assembly 200 of FIG. 5 is an assembly similar to rail crossing assembly 100 but for an oblique-angled track intersection. The least angle of intersection of the assembly traffic rails is typically in the range of 45° to 90° but in some applications may be more acute.

As shown in FIGS. 4 and 5, each rail crossing assembly 100 or 200 has four corners, and each corner is basically comprised of four spaced-apart but mechanically joined together corner castings. In the case of assembly 100 the four corner castings are referenced as 102 through 108 and each has the same right-angled planform, overall configuration, and size. In the case of assembly 200 the four corner castings are referenced as 202 through 208 with corner castings 202 and 204 having acute-angled planforms, and corner castings 206 and 208 having supplementary, obtuse-angled planforms. Each individual corner casting in each rail crossing corner assembly is spaced apart from its adjacent, co-operating individual corner casting by the width of the assembly car wheel flangeway 110 or 210 as hereinafter described. Additionally, each corner casting 102 through 108 (202 through 208) has one or two inboard ends 117 (217) which engage an intermediate rail element (112, 114) or (212, 214) and/or one or two outboard ends 119 (219) which engages one of a traffic rail element 118 (218) and guard 116 (216) rail element.

Figure 6:
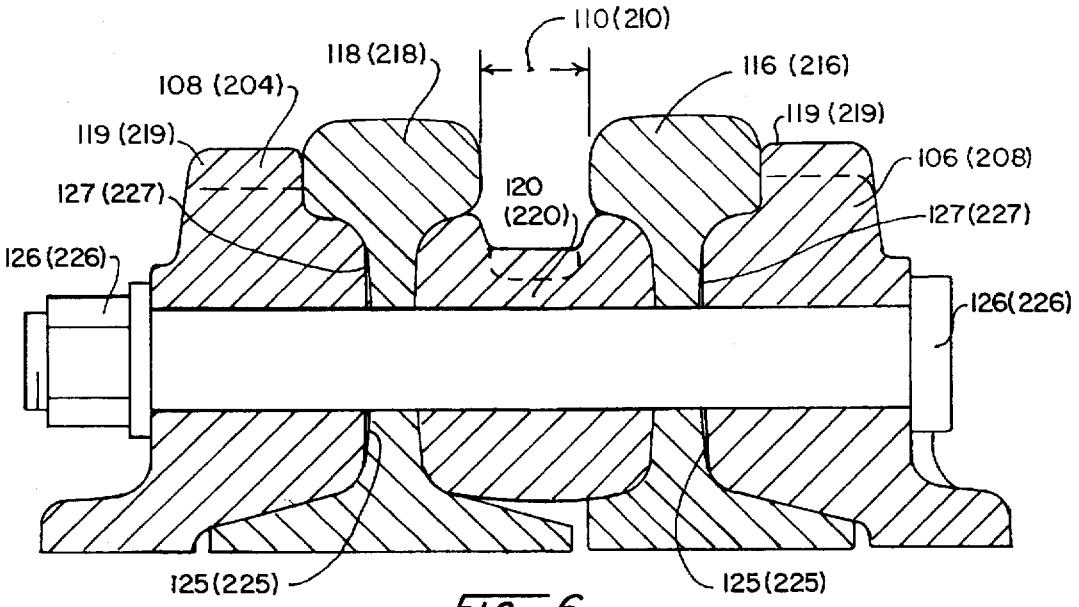
FIG. 6 is a section view taken at lines 6—6 in FIGS. 4 and 5.
Figure 7:
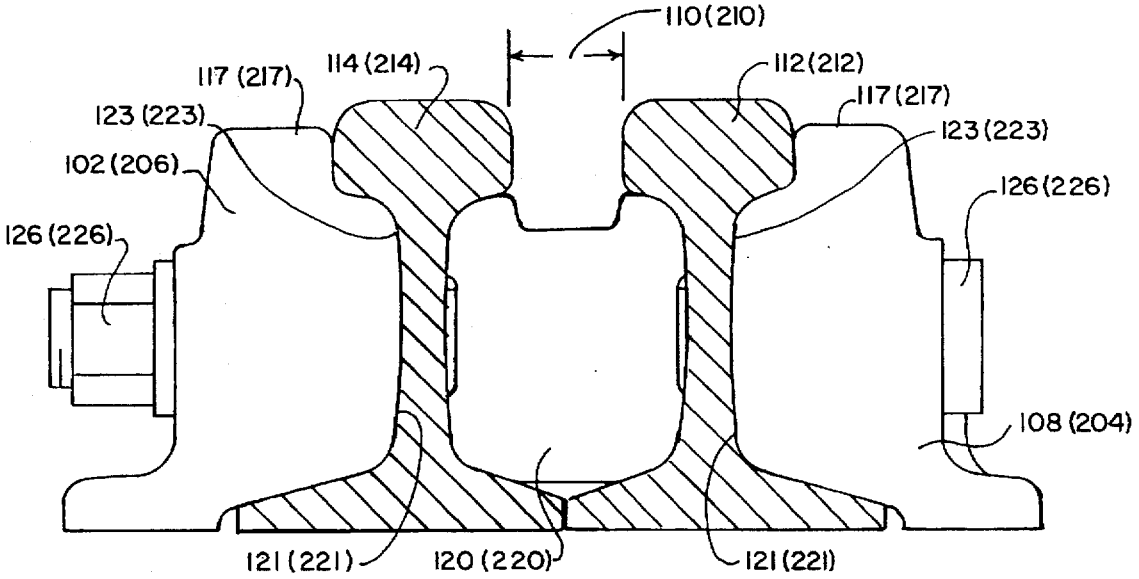
FIG. 7 is a section view taken at lines 7—7 of FIGS. 4 and 5.

Each inboard end 117 (217) of an individual corner casting 102 through 108 (202 through 208) in the rail crossing corner has a relatively straight flat planar vertical surface 121 (221) which co-operates with a straight flat planar vertical side 123 (223) at one end of a respective one of a pair of straight, spaced-apart intermediate rail elements 112 and 114 (FIG. 4), or 212 and 214 (FIGS. 5–7). Each outboard end 119 (219) of an individual corner casting 102 through 108 (202 through 208) in a rail crossing corner has a relatively straight flat planar vertical surface 125 (225) which co-operates with a straight flat planar vertical side 127 (227) at one end of a respective straight guard rail element 116 (or 216) or straight traffic rail element 118 (or 218). Each cooperating pair of traffic rail and guard rail elements in the rail crossing assembly is spaced apart by the width of the railcar wheel flangeway specified for that assembly. Also, and as will be later detailed, we prefer that the ends of all such rail elements have a mitered cut configuration that upon assembly abuts correspondingly mitered rail abutment surfaces respectively provided in each corner casting 102 through 108 or 202 through 208.

Each of assemblies 100 and 200 include multiple flangeway filler castings, including corner filler elements 120 and 220 installed in the rail crossing corners between the included intermediate rail elements, flared end filler elements 122 and 222 installed in the assemblies between each pair of co-operating traffic rail and guard rail elements, and guard chuck filler elements 124 and 224 also installed between each pair of cooperating traffic rail and guard rail elements. Threaded bolt and nut fasteners 126 and 226 of appropriate length, and preferably in accordance with AREA specifications for applicable special trackwork, are utilized throughout assemblies 100 and 200 to effect proper joinder of components 102 through 124 and components 202 through 224 into their respectively illustrated configurations. Such fasteners, for clarity of illustration purposes, are shown and detailed in the drawings only in connection with the included section views. See FIGS. 6 and 7, for instance.

Figure 8:
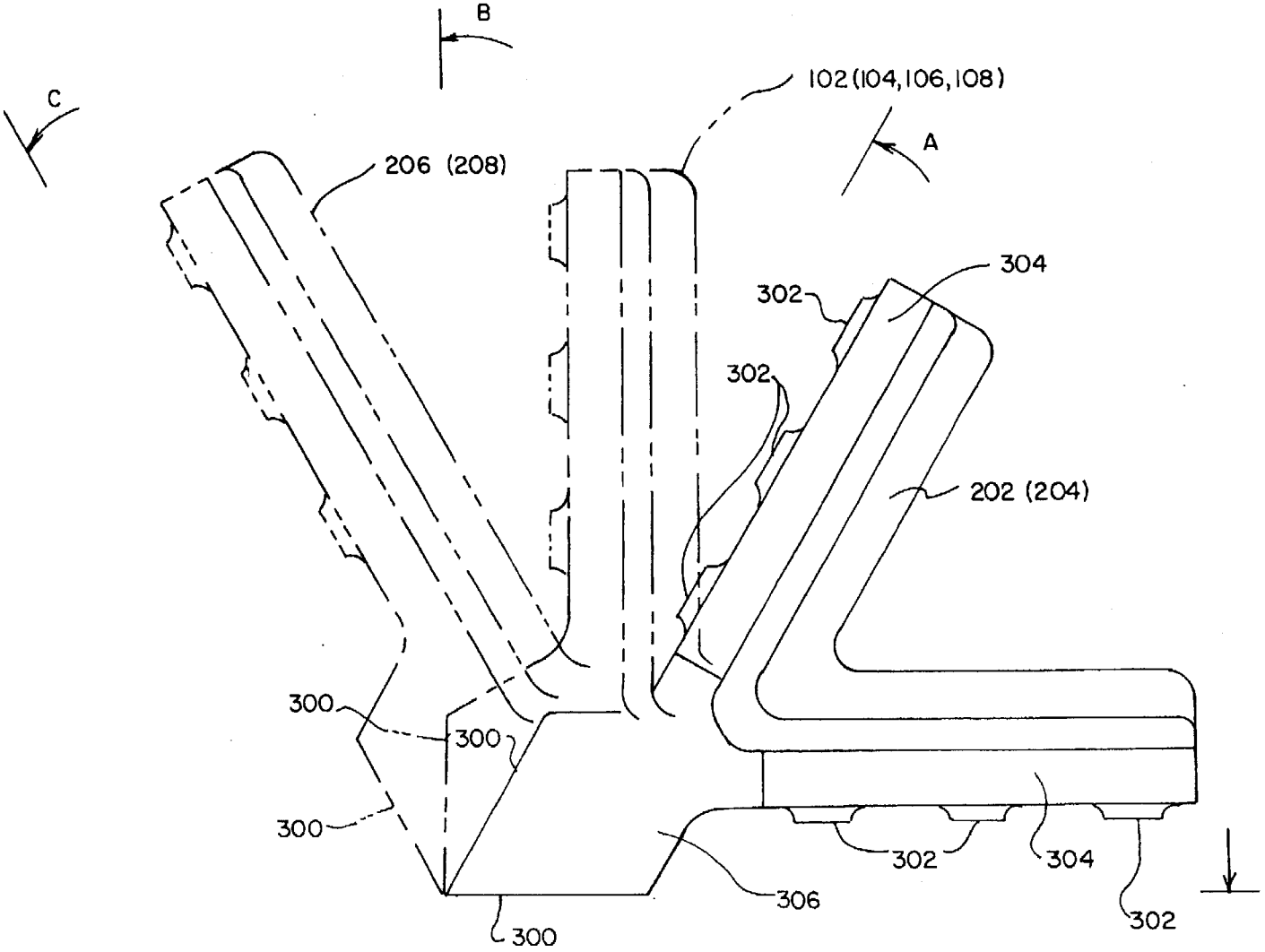
FIG. 8 is a plan view of a representative corner casting element.

FIG. 8 schematically illustrates the planforms for the corner casting elements incorporated into assemblies 100 and 200, e.g. corner castings having application to rail crossings with an intersection angle of approximately 90° (FIG. 4) or 60° (FIG. 5). Corner castings 102 through 108 each have the included angle B (90°) intermediate the flangeway faces 300 of the casting; acute-angled corner castings 202 and 204 for the 60° crossing intersection have the included angle A (60°), and the obtuse-angled corner castings 202 and 208 for that rail crossing intersection have the supplementary angle C (120°). It should also be noted that the assembly corner casting elements are each provided with cast-in-place fit pads 302 that may be subsequently machined to a closely-dimensioned height to assure a proper fit-up of the casting to its co-operating guard rail/traffic rail elements on final assembly. Most rail crossing installations utilized in the United States are custom designed to an exact angle of intersection to suit a specific site in a railroad trackwork system, and in most instances the angle of intersection is a specific angular value generally in the range of from 45° to 90°.

Figure 9:
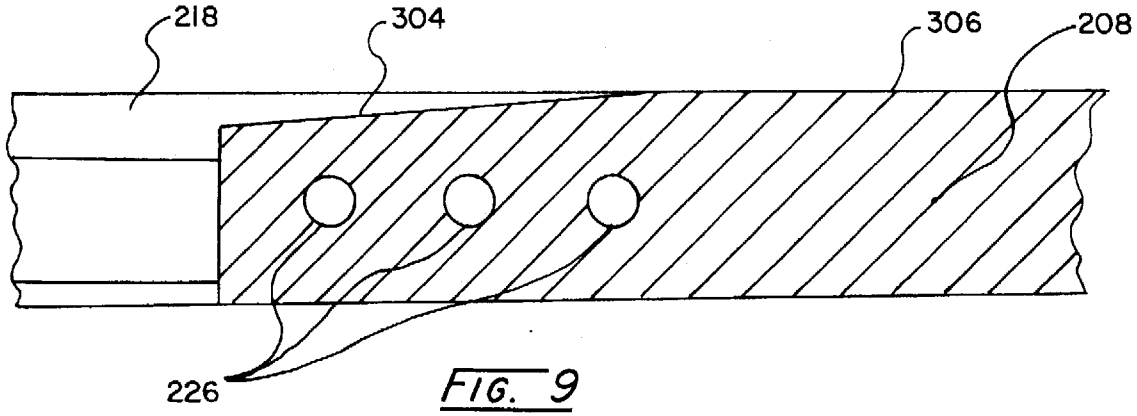
FIG. 9 is a partial section view taken at line 9—9 of FIGS. 5.

FIG. 9 is included in the drawings to more clearly illustrate that each corner casting in the rail crossing assembly of the present invention also preferably includes sloped "easer" ramps 304. See also FIG. 8. Each such easer slope or ramp element is conventional and is provided in rail crossing castings to minimize the impact loadings that would otherwise occur when the false flanges of a worn railcar wheel first contact the corner casting during a crossing operation.

Figure 10:
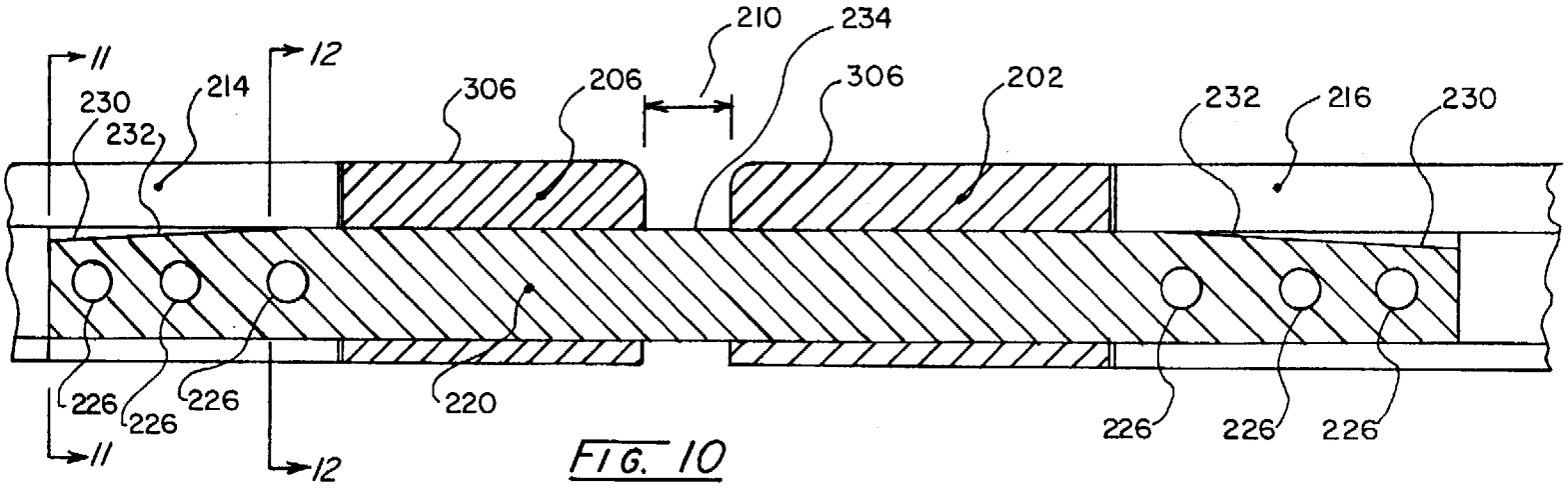
FIG. 10 is a partial section view illustrating in part a form of the assembly of FIGS. 4 and 5 as modified for use in a flange-bearing rail crossing installation.
Figure 11:
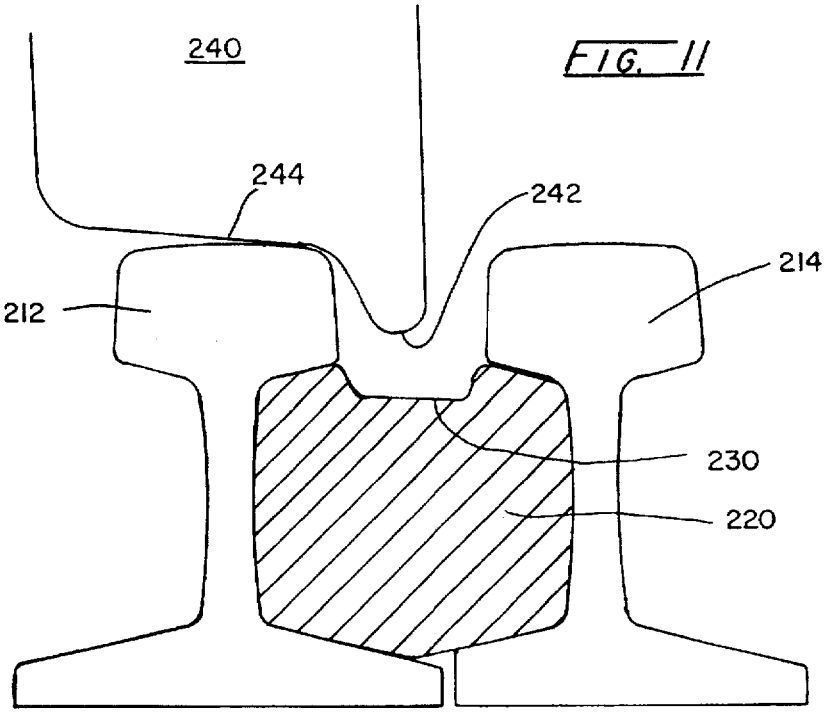
FIG. 11 is a section view taken at line 11—11 of FIG. 10.
Figure 12:
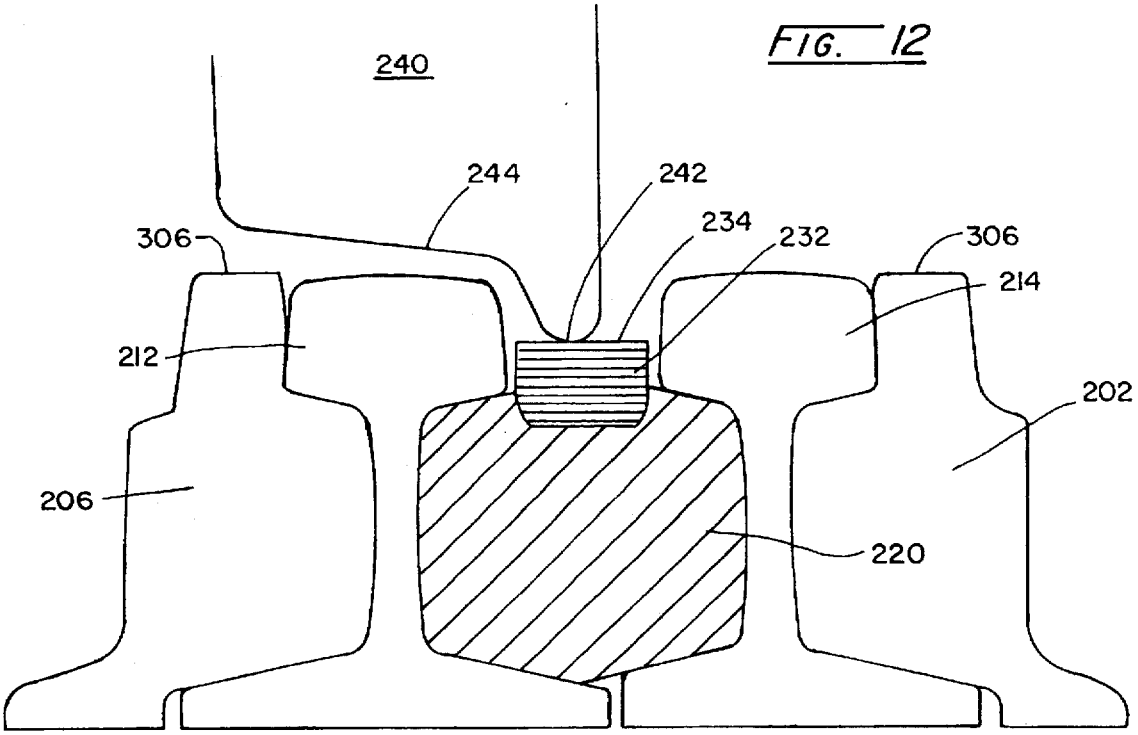
FIG. 12 is a section view taken at line 12—12 of FIG. 10.

FIG. 10 is provided in the drawings to illustrate the manner whereby the rail crossing assemblies of the present invention may be modified to be compatible with a somewhat increasingly desired flange-bearing mode of railcar wheel crossing operation. Basically the configuration of each corner casting 202 thru 208 in the assembly can be modified to allow the flangeway fillers 220 to be extended throughout the full length of each corner of the crossing to the extreme ends of the castings 202 and 206. The normal depth of the top horizontal surface of a flangeway filler 230 is designed to provide clearance for a normal wheel flange 242 as illustrated in FIG. 11. This allows the tapered tread 244 of a wheel 240 to contact the top running surface 306 of the crossing castings as is conventional industry practice. See FIG. 9. Since the deterioration due to wear and impact is normally imparted to the top surface 306 by the wheel tread 244, it is desirable to minimize or eliminate this as a contact point. By providing an upwardly tapering sloped surface 232 to the end portion 230 of flangeway filler 220 as seen in FIG. 10, the wheel flange is gradually elevated as it passes through the entry end of the corner on sloped surface 232 until it reaches the upper end of the sloped portion. Here it assumes an elevated position with flange 242 riding on and in contact with the horizontal flangeway filler surface 234. This now allows the wheel 240 and its corresponding tread surface 244 to become elevated above the top running surface 306 of the crossing as shown in FIG. 12. This is desirable as it allows the wheel 240 and corresponding wheel tread surface 244 to pass over and above the intersecting flangeway gap 210. This eliminates the sudden impact between wheel tread 244 and the top running surface 306 of the corner casting 202–208, which is the cause for wear, damage, and failure of crossing castings in normal existing configurations. The wheel 240 and corresponding tread surface 244 are then allowed to return to their normal elevation as they exit the corner of the crossing due to the downwardly sloping surface 232 at the opposite end. From the above it may be seen that the design allows for wheel elevation to be provided in both directions as the surface path of the top of the filler 230, 232, 234 is symmetrical at each corner location.

Utilization of the flangeway filler top surface to impart the flange bearing action is very desirable as the costly crossing corner castings 202 thru 208 do not have to be enlarged. The relatively inexpensive flangeway filler 220 can be further extended beyond the limits shown to provide for a longer more tapered sloped surface 232 thus allowing for a more gradual transition of the wheel elevation in higher speed applications and where smoother ride is desirable. As the top surface 234 of the flangeway filler becomes worn due to service it looses its elevating effectiveness, in this configuration the filler itself can be easily replaced to further extend the life of the crossing assembly.

The advantages of the present invention may be restated as including, at each rail crossing corner, four separate corner casting elements that necessarily need not be made of a manganese steel and that provide twice the number of reversing options in comparison to the prior art reversible casting rail crossing constructions. Additionally, the rail crossing construction utilizes no bent rail elements and does not contain a flangeway floor portion which has been prone to cracking failure due to stress concentration in this area on existing designs. Because the novel construction does not contain any bent rail elements it is not necessary to have any special beveled headlocks or beveled washers to accommodate bolt fasteners and permits the use of bolt fasteners which are of the same length throughout the entire assembly. Also, no special bent and machined corner strap elements are required to develop assembly unity and rigidity as that is accomplished by the corner castings themselves.

We claim our invention as follows:

1. A railroad trackwork rail crossing having at least one crossing corner, and comprising at each crossing corner;

four spaced-apart corner casting elements each having an angled planform and an upper point surface;

straight intermediate rail elements co-operating with the angled planforms of said corner casting elements;

straight traffic rail elements co-operating with the angled planforms of said corner casting elements;

straight guard rail elements co-operating with the angled planforms of said corner casting elements;

flangeway filler elements co-operating with said straight intermediate rail elements and with said straight traffic and guard rail elements to define railcar wheel flangeway therebetween; and bolt fasteners joining said corner casting elements, said straight intermediate rail element, said straight traffic rail elements, said straight guard rail elements, and said flangeway filler elements into a unitary rigid structure.

2. The railroad trackwork rail crossing invention defined by claim 1 wherein each of said four corner casting elements has a right-angled planform configuration and all of said corner casting elements are interchangeable with each other.

3. The railroad trackwork rail crossing invention defined by claim 1 wherein said four corner castings elements are comprised of two corner casting elements having an acute-angled planform configuration and two corner casting elements having a supplementary obtuse-angled planform configuration, said acute-angled planform configuration corner casting elements being interchangeable with each other and said obtuse-angled planform configuration corner casting elements also being interchangeable with each other.

4. The railroad trackwork rail crossing invention defined by claim 1 wherein at least one of said corner casting elements has an inboard end and an outboard end;

each of said inboard ends of said casting elements has a relatively straight planar surface which cooperates with a complementary surface at one end of a straight intermediate rail element; and each of said outboard ends of said casting elements has a relatively straight planar surface which cooperates with a complementary surface at one end of one of a straight guard rail element or a straight traffic rail element.

5. The railroad trackwork rail crossing invention defined by claim 1 where at least one of said corner casting elements has two inboard ends and each of said inboard ends has a relatively straight planar surface which cooperates with a complementary surface at one end of a straight intermediate rail element.

6. The railroad trackwork rail crossing invention defined by claim 1 where at least one of said corner casting elements has two outboard ends and each of said outboard ends has a relatively straight planar surface which cooperates with a complementary surface at one end of one of a straight guard rail element or a straight traffic rail element.

* * * * *